US005522950A

United States Patent [19]

Bartges et al.

[11] Patent Number: 5,522,950

[45] Date of Patent: Jun. 4, 1996

[54] SUBSTANTIALLY LEAD-FREE 6XXX ALUMINUM ALLOY

[75] Inventors: Charles W. Bartges, Delmont, Pa.; Thomas J. Klemp; Gerald D. Scott, both of Massena, N.Y.; Matthew J. Allyn, Waddington, N.Y.

[73] Assignee: Aluminum Company of America, Pittsburgh, Pa.

[21] Appl. No.: 307,194

[22] Filed: Sep. 16, 1994

Related U.S. Application Data

[63] Continuation-in-part of Ser. No. 92,706, Jul. 16, 1993, abandoned, which is a continuation-in-part of Ser. No. 34,090, Mar. 22, 1993, abandoned.

[51] Int. Cl.[6] ..... C22F 1/04; C22C 21/12

[52] U.S. Cl. ..... 148/550; 148/689; 148/690; 148/700; 148/417; 148/439; 420/530; 420/534; 420/535; 420/537; 420/538; 420/546; 420/553

[58] Field of Search ..... 148/550, 689, 148/690, 700, 417, 439; 420/530, 534, 535, 537, 538, 546, 553

[56] References Cited

U.S. PATENT DOCUMENTS 3,576,832 4/1971 Becker et al. ..... 420/530

5,282,909 2/1994 Ara et al. ..... 148/439

FOREIGN PATENT DOCUMENTS 63-007354 1/1988 Japan .

*Primary Examiner*—David A. Simmons
*Assistant Examiner*—Robert R. Koehler
*Attorney, Agent, or Firm*—Gary P. Topolosky

[57] ABSTRACT

An A-rated aluminum alloy suitable for machining, said alloy consisting essentially of: about 0.15–1.0 wt. % copper, about 1.01–1.5 wt. % tin, about 0.65–1.35 wt. % magnesium, about 0.4–1.1 wt. % silicon, about 0.00 2–0.35 wt. % manganese, up to about 0.5 wt. % iron, up to about 0.15 wt. % chromium and up to about 0.15 wt. % titanium, the remainder substantially aluminum. On a preferred basis, this alloy contains about 0.51–0.75 wt. % copper, about 1.1–1.3 wt. % tin, about 0.7–0.9 wt. % magnesium and about 0.45–0.75 wt. % silicon. The alloy is substantially free of lead, bismuth, nickel, zirconium and cadmium. There is further disclosed an improved method for making screw machine stock or wire, rod and bar product from this alloy by casting, preheating, extruding, solution heat treating, cold finishing and thermally processing the aforementioned alloy composition.

60 Claims, No Drawings

SUBSTANTIALLY LEAD-FREE 6XXX ALUMINUM ALLOY

This application is a continuation-in-part of U.S. application Ser. No. 08/092,706, filed on Jul. 16, 1993, now abandoned, which is a continuation-in-part of U.S. application Ser. No. 08/034,090, filed on Mar. 22, 1993, now abandoned both disclosures of which are fully incorporated by reference herein.

BACKGROUND OF THE INVENTION

1. Field of the Invention

This invention relates to the field of aluminum alloys, and more particularly to machinable aluminum alloys. The invention further relates to products made from such alloys, including but not limited to: screw machine stock; cold finished wire, rod and bar; extruded, cast, drawn or hot and cold rolled wire, rod and bar, and extruded, cast, drawn or hot and cold rolled forge stock.

2. Technology Review

There are several known machining alloys with 2011 and 6262 aluminum (Aluminum Association designations) being among the most commonly sold. It is generally difficult to measure the machinability of any such alloy. One ranking system that has been used for some time classifies machinability based on a letter scale with an "A" rating being most machinable, followed by "B", "C", "D" and "E" ratings taking into account the following characteristics:

(1) Chip Size. Smaller chip sizes are more desired because such chips simplify the machining operation and facilitate more effective heat removal from the tool workpiece interface than larger chips. Chips must not be too small or they interfere with lubricant recirculation during the overall machining operation, such as by drilling or cutting. Long, thin chips by contrast tend to curl around themselves rather than break. Such chips, sometimes called curlings, may require manual removal from the machining area and are less effective than smaller chips at heat dissipation because larger chips tend to block the cooling lubricant.

(2) Tool Wear. Lower tool wear rates are desired to save money by increasing the amount of time a tool can be used before prescribed tolerances for a given workpiece are exceeded. Lower tool wear rates further increase productivity by reducing downtime due to tool changeovers.

(3) Surface Finish. Alloys exhibiting a very smooth exterior surface finish in the as-machined condition are more desired to eliminate or reduce the need for subsequent surface finishing operations, such as grinding and deburring.

(4) Machining Forces. Lower machining forces are more desired to: reduce power requirements and the amount of frictional heat generated in the workpiece, tool and tool head; or increase the amount of machining or metal removal that can be accomplished with the same power requirements; and (5) Mechanical and Corrosion Properties. Mechanical characteristics such as strength, or other properties such as corrosion resistance, may be "optional" with respect to machinability. They can also be rather important depending on the intended end use for the workpiece being machined.

Although this "A" through "E" rating system is based on the five parameters discussed above, the relative importance of each parameter changes as a function of intended end use for any given alloy.

Currently, 2011 is the most popular aluminum machining alloy that is consistently "A" rated. This composition contains about 5–6 wt. % Cu, up to about 0.3 wt. % Zn, up to about 0.7 wt. % Fe, up to about 0.4 wt. % Si, about 0.2–0.6 wt. % Bi and about 0.2–0.6 wt. % Pb. 6262 aluminum is most often "B" rated but has consistently higher strength levels and better overall corrosion resistance in the T8 and T9 tempers when compared to its 2011-T3 counterparts. The composition for 6262 aluminum contains about 0.8–1.2 wt. % Mg, about 0.4–0.8 wt. % Si, about 0.15–0.4 wt. % Cu, about 0.4–0.7 wt. % Pb, about 0.4–0.7 wt. % Bi, about 0.04–0.14 wt. % Cr, up to about 0.7 wt. % Fe, up to about 0.25 wt. % Zn, up to about 0.15 wt. % Mn and up to about 0.15 wt. % Ti.

In the near future, it may be desirable to reduce the amount of lead in many products. Legislation may require Pb level reductions or even elimination from certain consumer goods. A lead-free substitute for 2011 and/or 6262 aluminum would be desirable, therefore.

SUMMARY OF THE INVENTION

A principal objective of the present invention is to provide a substantially lead-free substitute for 6262 aluminum. Another objective is to provide a lead-free, aluminum alloy with excellent machinability, thereby resulting in reduced manufacturing costs through faster machining times. It is another objective to provide an alloy which can be substituted for 2011 and/or 6262 aluminum in most machining applications, especially those where strength properties for the finished product are relatively less critical than machinability characteristics.

Another principal objective of this invention is to provide an improved screw machine stock and wire, rod or bar product, together with improved methods for making such products by casting, preheating, extruding, solution heat treating, cold finishing and thermally processing in various step combinations.

These and other objectives are met or exceeded by the present invention, one embodiment of which pertains to an aluminum alloy suitable for machining. This alloy consists essentially of: about 0.15–1.0 wt. % copper, about 0.4–1.5 wt. % tin, about 0.65–1.35 wt. % magnesium, about 0.4–1.1 wt. % silicon, about 0.002–0.35 wt. % manganese, up to about 0.5 wt. % iron, up to about 0.15 wt. % chromium and up to about 0.15 wt. % titanium, the remainder substantially aluminum and incidental elements and impurities. On a preferred basis, this alloy includes about 0.45–0.7 wt. % copper, about 0.9–1.3 wt. % tin, about 0.7–0.9 wt. % magnesium, about 0.45–0.75 wt. % silicon and about 0.01–0.05 manganese. It is substantially lead-free, bismuth-free, nickel-free, zirconium-free and cadmium-free as defined hereinafter. This alloy is typically processed into screw machine stock or one or more products selected from wire, rod and bar, most preferably by ingot casting and subsequent hot deformation.

There is further disclosed an improved method for making screw machine stock and wire, rod or bar product from this alloy by casting, preheating, extruding, solution heat treating, cold finishing and thermally processing, preferably to a T3, T8 or T851 temper (Aluminum Association designations). By extruding, cold finishing, and then solution heat treating (or solutionizing), this same alloy may be processed to such other tempers as T4, T451, T6 or T651. T9 tempering is also available by solution heat treating, thermally processing and cold finishing. The alloy of this invention may be: continuously cast using known or subsequently developed means; extruded into various product shapes without cold finishing; or even press quenched. After extrusion, products made from this alloy may be tempered according to T4511, T6510, T6511 or other T6 practices.

DETAILED DESCRIPTION OF PREFERRED EMBODIMENTS

For any description of preferred alloy compositions, all references to percentages are by weight percent (wt. %) unless otherwise indicated.

When referring to any numerical range of values, such ranges are understood to include each and every number and/or fraction between the stated range minimum and maximum. A range of about 0.4–1.5% tin, for example, would expressly include all intermediate values of about 0.41,0.42, 0.43 and 0.5%, all the way up to and including 1.45, 1.47 and 1.49% Sn. The same applies to each other elemental range set forth below.

As used herein, the term "substantially-free" means having no significant amount of that component purposefully added to the alloy composition, it being understood that trace amounts of incidental elements and/or impurities may find their way into a desired end product. For example, a substantially lead-free, machining alloy might contain less than about 0.1% Pb, or less than about 0.03% Pb on a more preferred basis, due to contamination from incidental additives or through contact with certain processing and/or holding equipment. All embodiments of the present invention are substantially Pb-free. The invention alloy is also substantially free of bismuth, nickel, zirconium, cadmium and thallium on a most preferred basis.

The term "screw machine stock", as used herein, describes cold finished wire, rod and bar product together with any extruded wire, rod or bar product which can be hot and cold rolled by conventional ingot metallurgy techniques (e.g., DC casting) or otherwise manufactured using known or subsequently developed powder metallurgy and casting processes. "Cold processing" is defined as working with substantially ambient temperatures while "hot working" uses heated stock for further processing. It is to be understood that, in some instances, cold processing can also follow hot working.

When referring to any preferred tempering treatment for this alloy, including T3, T4, T451, T4511, T6, T651, T651 0, T6511, T8, T851 and T9, understood that current tempering practices include: hot working; cold working; solution heat treating (or solutionizing); and precipitation hardening, either naturally (i.e., at ambient or room temperature) or artificially (using an external heat source). Particulars about any one tempering method may be learned from Aluminum Association registration guidelines, the disclosures of which are fully incorporated by reference herein.

While the aluminum alloy of this invention can be made into screw machine stock and wire, rod or bar product, preferably by extrusion, casting and/or hot or cold rolling, it is to be understood that the same alloy may be made into other forms and product shapes, including sheet, strip, plate, forgings, clad or foil products, by any known or subsequently developed technique, including continuous or semi-continuous casting.

When referring to the main alloying components of this invention, it is understood that a remainder of substantially aluminum may include some incidental, intentionally added elements which may impact collateral properties of the invention, or unintentionally added impurities, neither of which should change the essential characteristics of this alloy. With respect to the main alloying elements, it is believed that the copper hereof contributes to the alloy's overall machinability, strength, anodizing response, weldability and corrosion resistance response. The presence of tin is believed to contribute to both machinability and artificial aging response. For the lesser elements, chromium is believed to contribute to the formation of fine-dispersiod phases and prevent recrystallization during hot working or heat treatments. Manganese is believed to add to the alloy's strength, recrystallization and abrasion resistance. Silicon is also added for strength while iron is generally present as an impurity.

Tin is considered a viable substitute for lead for several reasons. Sn satisfies a majority of the criteria used to discern and develop a substantially lead-free substitute for 2011 and/or 6262 aluminum, namely: (1) having a low toxicity level; (2) generating minimal processing complications when substituting for the above aluminum alloys; (3) forming a low melting eutectic; (4) being generally insoluble in solid aluminum; (5) forming substantially no intermetallics with aluminum; and (6) having a net expansion upon melting.

One essential character of the present invention is believed to flow from the effect of melting a tin-magnesium eutectic, typically from the temperature rise in the region of a cutting tool during machining. Consequently, this invention may tolerate small amounts of such other elements as silver to further enhance strength properties without detrimentally affecting the aforementioned essential behavior characteristics. Evidence of this is noted by the inversely proportional relationship observed between Sn and Mg contents for the invention alloy. When a moderate amount of tin is present, Mg levels should be kept comparatively high. But with lower Mg contents, of about 0.9 wt. % or less, Sn contents of 0.95 wt. % or higher prove more beneficial.

The following examples are provided to further illustrate the objectives and advantages of this invention. They are not necessarily intended to limit the scope hereof in any manner.

TABLE 1a

| | Compositions | | | | | | |
|---|---|---|---|---|---|---|---|
| Alloy | Mg | Cu | Mn | Pb | Bi | Sn | Si |
| Repr. 6262 comp. | 0.88 | 0.34 | 0.02 | 0.54 | 0.50 | — | 0.59 |
| Invention Sample a | 0.66 | 0.30 | 0.003 | 0.0003 | — | 0.87 | 0.48 |
| Invention Sample b | 0.66 | 0.59 | 0.003 | 0.0009 | — | 0.95 | 0.48 |
| Invention Sample c | 0.91 | 0.31 | 0.003 | 0.0013 | — | 0.90 | 0.68 |
| Invention Sample d | 0.88 | 0.59 | 0.004 | 0.0039 | — | 0.94 | 0.72 |
| Invention Sample e | 0.94 | 0.63 | 0.004 | 0.0033 | — | 0.89 | 0.73 |
| Invention Sample f | 1.18 | 0.34 | 0.003 | 0.0000 | — | 0.95 | 0.87 |
| Invention Sample g | 1.17 | 0.58 | 0.006 | 0.0010 | — | 0.94 | 0.84 |
| Invention Sample h | 1.00 | 0.56 | 0.004 | 0.0035 | — | 1.10 | 0.72 |
| Invention Sample i | 1.00 | 0.59 | 0.010 | 0.0043 | — | 0.86 | 0.72 |
| Invention Sample j | 0.75 | 0.33 | 0.009 | 0.0017 | — | 1.24 | 0.51 |
| Invention | 0.72 | 0.59 | 0.006 | 0.0019 | — | 1.25 | 0.50 |

TABLE 1a-continued

| Alloy | Compositions Mg | Cu | Mn | Pb | Bi | Sn | Si |
|---|---|---|---|---|---|---|---|
| Sample k Invention | 1.01 | 0.30 | 0.004 | 0.0045 | — | 1.26 | 0.71 |
| Sample l Invention | 1.01 | 0.66 | 0.015 | 0.0271 | — | 1.39 | 0.73 |
| Sample m Invention | 1.14 | 0.32 | 0.006 | 0.0062 | — | 1.24 | 0.85 |
| Sample n Invention | 1.27 | 0.61 | 0.005 | 0.0051 | — | 1.26 | 0.95 |
| Sample o | | | | | | | |

TABLE 1b

| Alloy | T8 Tempered Tensile (ksi) | Yield (ksi) | % Elong. | # Chips/g | Tool Life (hrs) |
|---|---|---|---|---|---|
| Repr. 6262 | 51.2 | 49.3 | 15.2 | 165.17 | 1.28 |
| Invention Sample a | 42.57 | 39.27 | 16.67 | 310.67 | 1.23 |
| Invention Sample b | 44.71 | 41.30 | 14.72 | 291.11 | 1.27 |
| Invention Sample c | 47.63 | 45.38 | 12.92 | 123.67 | 2.79 |
| Invention Sample d | 49.12 | 45.92 | 14.42 | 199.33 | 0.67 |
| Invention Sample e | 51.28 | 48.72 | 13.83 | 119.83 | 1.98 |
| Invention Sample f | 54.22 | 52.20 | 13.17 | 172.67 | 1.65 |
| Invention Sample g | 55.65 | 54.20 | 9.08 | 166.50 | 1.42 |
| Invention Sample h | 49.18 | 47.25 | 15.50 | 173.17 | 1.93 |
| Invention Sample i | 52.11 | 49.94 | 13.11 | 146.44 | 2.40 |
| Invention Sample j | 42.50 | 39.60 | 15.42 | 313.00 | 1.51 |
| Invention Sample k | 45.98 | 42.46 | 16.00 | 256.67 | 0.81 |
| Invention Sample l | 45.33 | 43.17 | 13.33 | 235.67 | 1.90 |
| Invention Sample m | 48.35 | 45.60 | 13.42 | 289.33 | 0.88 |
| Invention Sample n | 50.37 | 48.93 | 12.00 | 160.83 | 2.09 |
| Invention Sample o | 55.17 | 53.47 | 10.83 | 163.33 | 1.87 |
| Invention Average | 48.94 | 46.49 | 13.63 | 208.15 | 1.63 |

TABLE 1c

| Alloy | T9 Tempered Tensile (ksi) | Yield (ksi) | % Elong. | # Chips/g | Tool Life (hrs) |
|---|---|---|---|---|---|
| Repr. 6262 | 53.0 | 51.1 | 10.0 | 144.67 | 1.58 |
| Invention Sample a | 49.78 | 47.82 | 8.33 | 281.17 | 0.90 |
| Invention Sample b | 50.85 | 48.90 | 8.42 | 280.83 | 0.84 |
| Invention Sample c | 55.58 | 53.55 | 9.92 | 147.67 | 2.46 |
| Invention Sample d | 57.45 | 54.92 | 8.25 | 190.67 | 1.51 |
| Invention Sample e | 57.10 | 54.82 | 8.77 | 183.00 | 1.59 |
| Invention Sample f | 55.78 | 53.67 | 10.83 | 159.33 | 1.46 |
| Invention Sample g | 59.30 | 56.65 | 8.92 | 194.17 | 1.76 |
| Invention Sample h | 55.82 | 53.52 | 8.50 | 179.00 | 1.95 |
| Invention Sample i | 58.84 | 55.96 | 8.44 | 173.00 | 1.79 |
| Invention Sample j | 49.62 | 47.58 | 10.42 | 265.67 | 0.78 |
| Invention Sample k | 51.66 | 50.02 | 7.89 | 257.44 | 0.76 |
| Invention Sample l | 52.40 | 50.43 | 6.50 | 225.00 | 1.68 |
| Invention Sample m | 55.77 | 53.77 | 6.42 | 253.17 | 0.84 |
| Invention Sample n | 54.55 | 52.35 | 8.42 | 163.17 | 1.90 |
| Invention Sample o | 57.53 | 55.63 | 5.83 | 213.33 | 0.61 |
| Invention Average | 54.80 | 52.64 | 8.39 | 211.11 | 1.39 |

From the aforementioned tables, it is noted that a higher chip per gram number equates to more chips and thus smaller sized chips, which in turn indicates better alloy machinability. Using this criterion alone, those invention alloy compositions with lower Mg contents and relatively higher Sn weight percentages, especially Invention Samples b and k, outperformed 6262 aluminum.

Having described the presently preferred embodiments, it is to be understood that the invention may be otherwise embodied by the scope of the claims appended hereto.

What is claimed is:

1. An aluminum alloy with improved machining properties which is substantially free of nickel, zirconium and cadmium, and consists essentially of: about 0.15–1.0 wt. % copper, about 1.01–1.5 wt. % tin, about 0.65–1.35 wt. % magnesium, about 0.4–1.1 wt. % silicon, about 0.002–0.35 wt. % manganese, up to about 0.5 wt. % iron, up to about 0.15 wt. % chromium, up to about 0.15 wt. % titanium, less than about 0.09 wt. % lead and less than about 0.09 wt. % bismuth, the remainder substantially aluminum.

2. The aluminum alloy of claim 1 which contains about 0.45–0.7 wt. % copper.

3. The aluminum alloy of claim 1 which contains about 1.1–1.3 wt. % tin.

4. The aluminum alloy of claim 1 which contains about 0.7–0.9 wt. % magnesium.

5. The aluminum alloy of claim 1 which contains about 0.45–0.75 wt. % silicon.

6. An aluminium-based alloy with improved machining properties which is substantially free of nickel, zirconium and cadmium, and comprises: about 0.15–1.0 wt % copper, about 1.10–1.5 wt % tin, about 0.65–1.35 wt % magnesium, about 0.4–1.1 wt % silicon, about 0.002–0.35 wt % manganese, up to about 0.5 wt % iron, up to about 0.15 wt % chromium, up to about 0.15 wt % titanium, less than about 0.09 wt % lead and less than about 0.09 wt % bismuth, the balance substantially aluminum, incidental elements and impurities.

7. The alloy of claim 6 which contains about 0.45–0.7 wt. % copper.

8. The alloy of claim 6 which contains about 1.1–1.3 wt. % tin.

9. The alloy of claim 6 which contains about 0.7–0.9 wt. % magnesium.

10. The alloy of claim 6 which contains about 0.45–0.75 wt. % silicon.

11. A screw machine stock made from an aluminum-based alloy which is substantially free of zirconium and consists essentially of: about 0.15–1.0. wt. % copper, about 1.01–1.5 wt. % tin, about 0.65–1.35 wt. % magnesium, about 0.4–1.1 wt. % silicon, about 0.002–0.35 wt. % manganese, up to about 0.5 wt. % iron, up to about 0.15 wt. % chromium, up to about 0.15 wt. % titanium, less than about 0.09 wt. % lead and less than about 0.09 wt. % bismuth, the remainder substantially aluminum, said screw machine stock having improved machining properties.

12. The screw machine stock of claim 11 wherein the alloy contains about 0.45–0.7 wt. % copper.

13. The screw machine stock of claim 11 wherein the alloy contains about 1.1–1.3 wt. % tin.

14. The screw machine stock of claim 11 wherein the alloy contains about 0.7–0.9 wt. % magnesium.

15. The screw machine stock of claim 11 wherein the alloy contains about 0.45–0.75 wt. % silicon.

16. The screw machine stock of claim 11 wherein the alloy has been thermally processed to a temper selected from the group consisting of T3, T4, T451, T4511, T6, T651, T6510, T6511, T8, T851 and T9.

17. A product selected from the group consisting of wire, rod and bar, said product having improved machining properties and being made from an aluminum-based alloy which is substantially free of zirconium and consists essentially of: about 0.15–1.0 wt. % copper, about 1.01–1.5 wt. % tin, about 0.65–1.35 wt. % magnesium, about 0.4–1.1 wt. % silicon, about 0,002–0.35 wt. % manganese, up to about 0.5 wt. % iron, up to about 0.15 wt. % chromium, up to about 0.15 wt. % titanium, less than about 0.09 wt. % lead and less than about 0.09 wt. % bismuth, the balance substantially aluminum, incidental elements and impurities.

18. The product of claim 17 wherein the alloy contains about 0.45–0.7 wt. % copper.

19. The product of claim 17 wherein the alloy contains about 1.1–1.3 wt. % tin. wt. % tin.

20. The product of claim 17 wherein the alloy contains about 0.7–0.9 wt. % magnesium.

21. The product of claim 17 wherein the alloy contains about 0.45–0.75 wt. % silicon.

22. The product of claim 17 which has been thermally processed to a temper selected from the group consisting of: T3, T4, T451, T4511, T6, T651, T6510, T6511, T8, T851 and T9.

23. The product of claim 17 which was manufactured by a method selected from the group consisting of: extrusion; casting; hot and cold rolling; and combinations thereof.

24. In a method for manufacturing an aluminum-based alloy product selected from the group consisting of: screw machine stock; cold-finished wire, rod or bar; extruded wire, rod or bar; cast wire, rod or bar; and hot and cold-rolled wire, rod or bar, said product having improved machining properties and said manufacturing method including casting, preheating, extruding, solution heat treating, and thermally processing an aluminum-based alloy, the improvement which comprises providing as the alloy a composition which is substantially free of zirconium and consists essentially of: about 0.15–1.0 wt. % copper, about 1.01–1.5 wt. % tin, about 0.65–1.35 wt. % magnesium, about 0.4–1.1 wt. % silicon, about 0.002–0.35 wt. % manganese, up to about 0.5 wt. % iron, up to about 0.15 wt. % chromium, up to about 0.15 wt. % titanium, less than about 0.09 wt. % lead and less than about 0.09 wt. % bismuth, the balance substantially aluminum, incidental elements and impurities.

25. The improvement of claim 24 wherein the alloy contains about 0.45–0.7 wt. % copper.

26. The improvement of claim 24 wherein the alloy contains about 1.1–1.3 wt. % tin.

27. The improvement of claim 24 wherein the alloy contains about 0.7–0.9 wt. % magnesium.

28. The improvement of claim 24 wherein the alloy contains about 0.45–0.75 wt. % silicon.

29. The improvement of claim 24 wherein the alloy is thermally processed to a temper selected from the group consisting of: T3, T4, T451, T4511, T6, T651, T6510, T6511, T8, T851 and T9.

30. In a method of producing an aluminum alloy product by casting, extruding, solution heat treating, and thermally processing aluminum alloy stock, said product having improved machining properties, the improvement which comprises providing as said aluminum alloy stock, a composition which is substantially free of zirconium and consists essentially of: about 0.15–1.0 wt. % copper, about 1.01–1.5 wt. % tin, about 0.65–1.35 wt. % magnesium, about 0.4–1.1 wt. % silicon, about 0.002–0.35 wt. % manganese, up to about 0.5 wt. % iron, up to about 0.15 wt. % chromium, up to about 0.15 wt. % titanium, less than about 0.09 wt. % lead and less than about 0.09 wt. % bismuth, the balance substantially aluminum, incidental elements and impurities.

31. The improvement of claim 30 wherein said composition contains about 0.45–0.7 wt. % copper.

32. The improvement of claim 30 wherein said composition contains about 1.1–1.3 wt. % tin.

33. The improvement of claim 30 wherein said composition contains about 0.7–0.9 wt. % magnesium.

34. The improvement of claim 30 wherein said composition contains about 0.45–0.75 wt. % silicon.

35. The improvement of claim 30 wherein said stock is thermally processed to a temper selected from the group consisting of: T3, T4, T451, T4511, T6, T651, T6510, T6511, T8, T851 and T9.

36. A screw machine stock made from an aluminum-based alloy which is substantially free of zirconium and consists essentially of: about 0.51–1.0 wt. % copper, about 0.4–1.5 wt. % tin, about 0.65–1.35 wt. % magnesium, about 0.4–1.1 wt. % silicon, about 0.002–0.35 wt. % manganese, up to about 0.5 wt. % iron, up to about 0.15 wt. % chromium, up to about 0.15 wt. % titanium, less than about 0.09 wt. % lead and less than about 0.09 wt. % bismuth, the remainder substantially aluminum, said screw machine stock having improved machining properties.

37. The screw machine stock of claim 36 wherein the alloy contains about 0.55–0.75 wt. % copper.

38. The screw machine stock of claim 36 wherein the alloy contains about 0.9–1.3 wt. % tin.

39. The screw machine stock of claim 36 wherein the alloy contains about 0.7–0.9 wt. % magnesium.

40. The screw machine stock of claim 36 wherein the alloy contains about 0.45–0.75 wt. % silicon.

41. The screw machine stock of claim 36 wherein the alloy has been aged to a temper selected front the group consisting of T3, T4, T451, T4511, T6, T651, T6510, T6511, T8, T851 and T9.

42. A product selected from the group consisting of wire, rod and bar, said product having improved machining properties and being made from an aluminum-based alloy which is substantially free of zirconium and consists essentially of: about 0.51–1.0 wt. % copper, about 0.4–1.5 wt. % tin, about 0.65–1.35 wt. % magnesium, about 0.4–1.1 wt. % silicon, about 0.002–0.35 wt. % manganese, up to about 0.5 wt. % iron, up to about 0.15 wt. % chromium, up to about 0.15 wt. % titanium, less than about 0.09 wt. % lead and less than about 0.09 wt. % bismuth, the balance substantially aluminum, incidental elements and impurities.

43. The product of claim 42 wherein the alloy contains about 0.55–0.75 wt. % copper.

44. The product of claim 42 wherein the alloy contains about 0.9–1.3 wt. % tin.

45. The product of claim 42 wherein the alloy contains about 0.7–0.9 wt. % magnesium.

46. The product of claim 42 wherein the alloy contains about 0.45–0.75 wt. % silicon.

47. The product of claim 42 which has been aged to a temper selected from the group consisting of: T3, T4, T451, T4511, T6, T651, T6510, T6511, T8, T851 T9.

48. The product of claim 42 which was manufactured by a method selected from the group consisting of: extrusion; casting; hot and cold rolling; and combinations thereof.

49. In a method for manufacturing an aluminum-based alloy product selected from the group consisting of: screw machine stock; cold-finished wire, rod or bar; extruded wire, rod or bar; cast wire, rod or bar; and hot and cold-rolled wire, rod or bar, said product having improved machining properties, said manufacturing method including casting, preheating, extruding, solution heat treating, and aging an aluminum-based alloy, the improvement which comprises providing as the alloy a composition which is substantially free of zirconium and consists essentially of: about 0.15–1.0 wt. % copper, about 0.4–1.5 wt % tin, about 0.65–1.35 wt. % magnesium, about 0.4–1.1 wt. % silicon, about 0.002–0.35 wt. % manganese, up to about 0.5 wt. % iron, up to about 0.15 wt. % chromium, up to about 0.15 wt. % titanium, less than about 0.09 wt. % lead and less than about 0.09 wt. % bismuth, the balance substantially aluminum, incidental elements and impurities.

50. The improvement of claim 49 wherein the alloy contains about 0.55–0.75 wt. % copper.

51. The improvement of claim 49 wherein the alloy contains about 0.9–1.3 wt. % tin.

52. The improvement of claim 49 wherein the alloy contains about 0.7–0.9 wt. % magnesium.

53. The improvement of claim 49 wherein the alloy contains about 0.45–0.75 wt. % silicon.

54. The improvement of claim 49 wherein the alloy is aged to a temper selected from the group consisting of: T3, T4, T451, T4511, T6, T651, T6510, T6511, T8, T851 and T9.

55. In a method of producing a machined aluminum alloy product by casting, extruding, solution heat treating, and aging aluminum alloy stock, said product having improved machining properties, the improvement which comprises providing as said aluminum alloy stock, a composition which is substantially free of zirconium and consists essentially of: about 0.51–1.0 wt. % copper, about 0.4–1.5 wt. % tin, about 0.65–1.35 wt. % magnesium, about 0.4–1.1 wt. % silicon, about 0.002–0.35 wt. % manganese, up to about 0.5 wt. % iron, up to about 0.15 wt. % chromium, up to about 0.15 wt. % titanium, less than about 0.09 wt. % lead and less than about 0.09 wt. % bismuth, the balance substantially aluminum and impurities.

56. The improvement of claim 55 wherein said composition contains about 0.55–0.75 wt. % copper.

57. The improvement of claim 55 wherein said composition contains about 0.9–1.3 wt. % tin.

58. The improvement of claim 55 wherein said composition contains about 0.7–0.9 wt. % magnesium.

59. The improvement of claim 55 wherein said composition contains about 0.45–0.75 wt. % silicon.

60. The improvement of claim 55 wherein said stock is aged to a temper selected from the group consisting of: T3, T4, T45 1, T4511, T6, T651, T6510, T6511, T8, T851 and T9.

* * * * *

UNITED STATES PATENT AND TRADEMARK OFFICE

CERTIFICATE OF CORRECTION

PATENT NO. : 5,522,950

DATED : June 4, 1996

INVENTOR(S) : Charles W. Bartges et al.

It is certified that error appears in the above-indentified patent and that said Letters Patent is hereby corrected as shown below:

| | |
|---|---|
| Column 6, claim 6, line 4 | After "about" (first occurrence) change "1.10" to --1.01-- |
| Column 7, claim 17, line 7 | After "about" (first occurrence) change "0,002" to --0.002-- |
| Column 8, claim 49, line 10 | After "about" change "0.15" to --0.51-- |
| Column 10, claim 60, line 3 | Change "T45 1" to --T451-- |

Signed and Sealed this

Twenty-second Day of April, 1997

Bruce Lehman

*Attest:*

BRUCE LEHMAN

*Commissioner of Patents and Trademarks*

*Attesting Officer*